US005464165A

United States Patent [19]

DeDeimar et al.

[11] Patent Number: 5,464,165

[45] Date of Patent: Nov. 7, 1995

[54] CONE CRUSHER HAVING INCLINED HOLD-DOWN CYLINDERS

[75] Inventors: Ronald B. DeDeimar, San Ramon; Greg F. Lach, Dublin, both of Calif.

[73] Assignee: W. S. Tyler, Incorporated, Gastonia, N.C.

[21] Appl. No.: 284,099

[22] Filed: Aug. 1, 1994

Related U.S. Application Data

[63] Continuation-in-part of Ser. No. 192,484, Feb. 7, 1994, abandoned.

[51] Int. Cl.[6] ..... B02C 2/04

[52] U.S. Cl. ..... 241/215; 241/290

[58] Field of Search ..... 241/207, 208, 241/214, 286, 290, 215

[56] References Cited

U.S. PATENT DOCUMENTS

| | | | |
|---|---|---|---|
| 3,604,640 | 9/1971 | Webster et al. . | |
| 3,638,870 | 2/1972 | Ferris . | |
| 3,754,716 | 8/1973 | Webster . | |
| 4,478,373 | 10/1984 | Gieschen . | |
| 4,589,600 | 5/1986 | Schuman | 241/208 X |
| 4,615,491 | 10/1986 | Batch et al. . | |
| 5,115,991 | 5/1992 | Saari | 241/208 |

FOREIGN PATENT DOCUMENTS

| | | |
|---|---|---|
| 893686 | 2/1972 | Canada . |
| 1517963 | 7/1978 | United Kingdom . |

*Primary Examiner*—Timothy V. Eley
*Attorney, Agent, or Firm*—Donald L. Beeson

[57] ABSTRACT

A cone crusher having a lower frame assembly and upper bowl assembly is provided with hold-down cylinders arranged in pairs which are oppositely inclined to counteract a rotational impact forces imparted to the upper bowl assembly. Additionally, the hold-down cylinders are inwardly inclined toward the gyratory axis of the crusher to exert a self-centering force on the upper bowl assembly. The paired and inclined cylinders form a conical truss arrangement that reduces the need for costly maintenance, repairs, and replacement of the hold-down cylinders.

17 Claims, 9 Drawing Sheets

CONE CRUSHER HAVING INCLINED HOLD-DOWN CYLINDERS

CROSS-REFERENCE TO RELATED APPLICATIONS

This is a continuation-in-part of application Ser. No. 08/192,484, filed Feb. 7, 1994, now abandoned.

BACKGROUND OF THE INVENTION

The present invention generally relates to cone crushers, also known as gyratory crushers, which are a widely used type of crushing machine for reducing rock and other aggregate materials into finer particles; the invention more particularly relates to the overload protection feature of a cone crusher which allows uncrushable materials, such as tramp iron, to pass through the crusher without damaging the machine's crushing members.

The crushing forces of a cone crusher are generated by the gyratory motion of a cone-shaped crusher head eccentrically driven in opposition to an inverted concave or crusher bowl. The crusher bowl is carried in an upper bowl assembly which seats on the lower frame assembly housing the crusher head. This bowl assembly is vertically movable in respect to the lower frame assembly to permit the crusher bowl to lift away from the crusher head in an overload condition occurring when an uncrushable enters the annular crushing region between the crusher head and the bowl. (The ability of the bowl to lift away from the crusher head also permits the crushing chamber to be cleared when the machine is not in operation.) Such overload protection permits uncrushables to pass through the crusher without damaging the crusher and without causing down time associated with the crusher repairs.

Known approaches to providing overload protection in a cone crusher include the use of either coil springs or hydraulic cylinders to releasably hold the crusher's upper bowl assembly down onto its lower frame assembly. Of these two approaches, there are a number of advantages that recommend the use of hydraulic cylinders over springs. These advantages include tension adjustability, responsiveness to an overload condition, extendibility and safety—safety because the hold-down forces exerted by the hydraulic cylinders can be released when an operator physically accesses the crusher's chamber for maintenance and cleaning. However, hydraulic cylinders have a particular disadvantage in that the cylinders normally require considerable maintenance and frequent repairs due to the extreme forces exerted on the cylinders under normal operating conditions. More specifically, in conventional hydraulic overload protection designs, the hydraulic cylinders experience tremendous radial forces (sometimes referred to herein as lateral forces) and torsional forces which quickly wear out or damage the seals and other parts of the cylinders. The radially directed forces tend to uncenter the upper bowl assembly and occur as the upper assembly tips up in an overload condition. The torsional or rotating forces, on the other hand, are impact forces produced whenever the gyrating crusher head strikes an uncrushable and drives it against the bowl of the upper bowl assembly.

The use of hydraulic cylinders for overload protection is disclosed in U.S. Pat. No. 4,478,373 to Gieschen and U.S. Pat. No. 4,615,491 to Batch, et al. In both the Batch and Gieschen patents, hold-down cylinders are designed to release when uncrushables enter the annular crushing region between the lower and upper assemblies of the crusher. In each case, the hold-down cylinders extend between the two assemblies in a vertical orientation with the cylinder's piston rod being connected to the upper bowl assembly in the case of Gieschen and the lower frame assembly in the case of Batch. In each case, wear producing forces, both radial and torsional, will be exerted on the upper end of the cylinder—that is, on the end connected to the upper bowl assembly—when the upper bowl assembly reacts to an overload condition. The present invention is intended to reduce wear on the hold-down cylinders, and to reduce the maintenance and repair, and resulting down time, associated therewith.

SUMMARY OF THE INVENTION

Briefly, the invention involves inclining the hydraulic cylinders of a hydraulic overload protection system of a cone crusher so as to minimize the effects of radial and torsional forces imparted to the cylinders during an overload condition. The invention particularly involves inclining the cylinders inwardly from their base end, that is, the end secured to the lower frame assembly, in the direction of the crusher's gyratory axis, such that, the cylinders form a conical truss arrangement having an apex substantially above the point of nutation for the eccentrically driven crusher head. This inclination provides an inwardly directed self-centering force to the upper bowl assembly which counteracts radially directed stress on the cylinders.

In another aspect of the invention, the hold-down cylinders are arranged in pairs with the cylinders in each pair being oppositely inclined toward each other from their base ends so that they can provide a circumferential, anti-rotational force component, as well as a vertical hold-down force component. By suitably pressurizing cylinder pairs, torsional impact forces imparted to the upper bowl assembly will be counteracted to relieve stress on the cylinders resulting from these forces.

It is contemplated that, in the best and preferred mode of the invention, the cylinders will be arranged in oppositely inclined pairs and that the oppositely inclined pairs will be inwardly inclined toward the gyratory axis whereby the cylinders can provide both anti-rotational and self-centering forces. However, it is understood that a cone crusher in accordance with the invention could be designed with either of these features, that is, with either a self-centering inclined arrangement and/or in an anti-rotational paired arrangement.

The invention still further involves the use of a hydraulic circuit for pressurizing the hold-down cylinders which includes upwards of one accumulator for each cylinder and as few as one accumulator for all cylinders.

It is therefore a primary object of the invention to reduce the frequency of repairs to the hydraulic cylinders of a conventional hydraulic overload protection system for a cone crusher. It is a further object of the invention to reduce the down time associated with cylinder maintenance, replacement and repair. Other objects of the invention will be apparent from the following specification and claims.

DETAILED DESCRIPTION OF THE ILLUSTRATED EMBODIMENT

Figure 1:
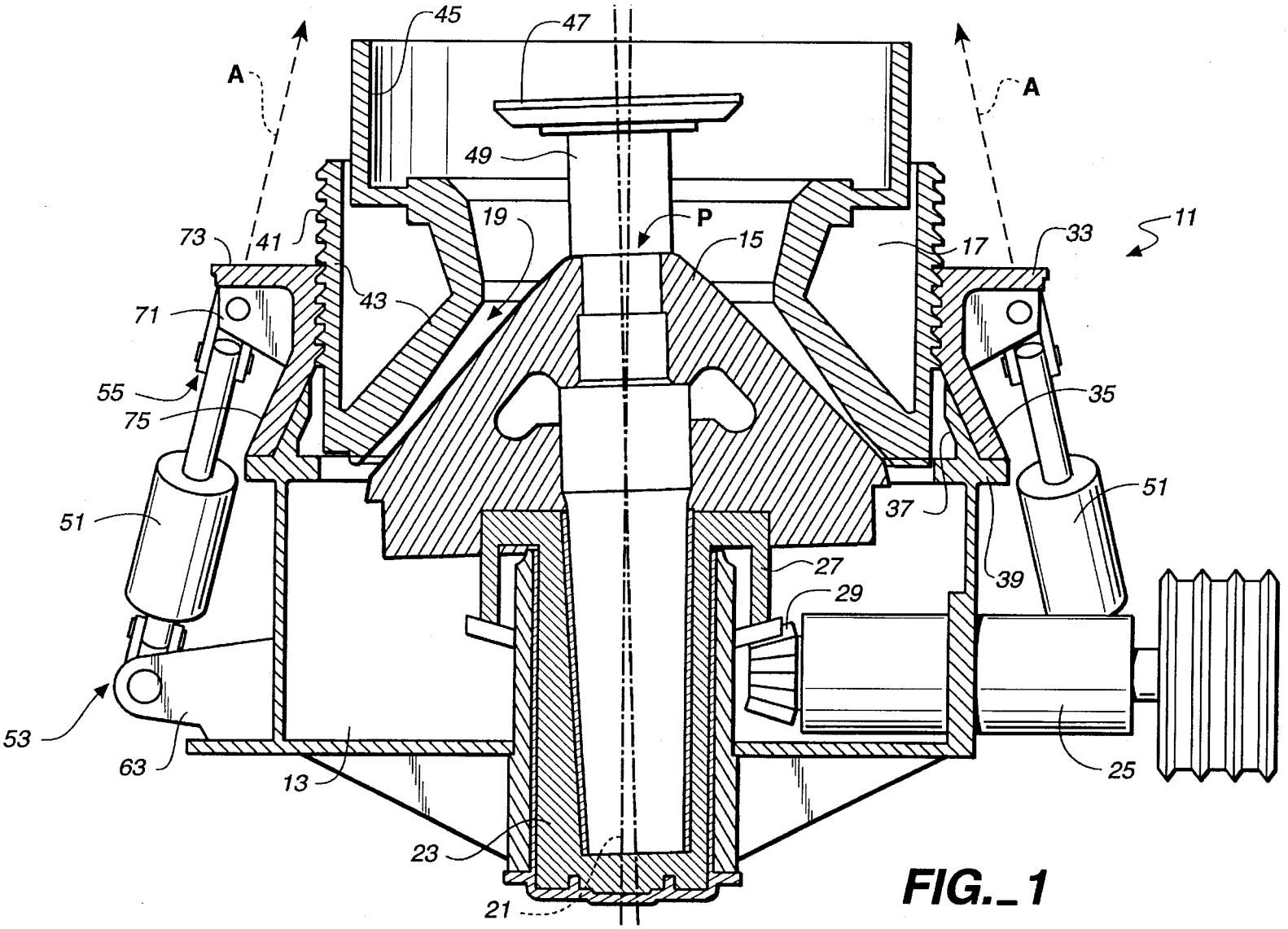
FIG. 1 is a side elevational view, in cross-section, of a simplified rendition of a cone crusher using inclined hold-down cylinders in accordance with the invention.
Figure 2:
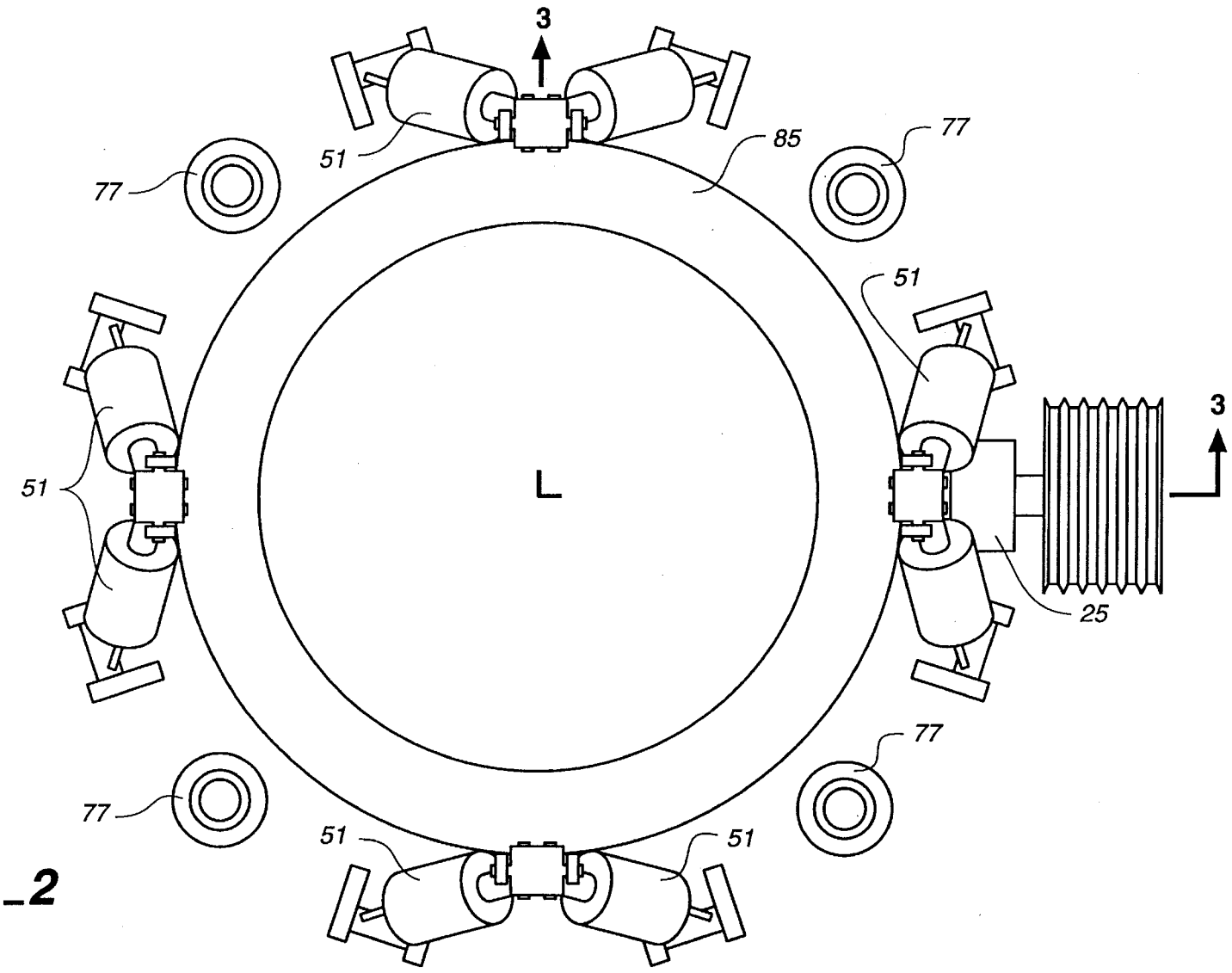
FIG. 2 is a top plan pictorial view of the simplified cone crusher shown in FIG. 1.

Referring now to the drawings, FIGS. 1 and 2 illustrate, in a simplified form, the basic components of a cone crusher having hydraulic cylinders for overload protection deployed in accordance with the invention. Generally, crusher 11 has lower frame assembly 13 which carries a crusher head 15, and an upper bowl assembly 17 which supports an inverted crusher bowl or concave (not separately shown in FIG. 1, but shown in FIG. 3) over and in opposition to the crusher head so as to form a crusher crushing chamber 19. It can be seen that the crushing head is driven in a gyratory motion about gyratory axis 21 by an eccentric 23 which is coupled to drive shaft 25 by means of skirt gear 27 and pinion 29. The material to be crushed in crushing chamber 19 is fed through hopper 45 situated on top of the upper bowl assembly. A gyrating distributor 47 connected to the top of the crusher head 15 by means of extension 49 acts to distribute material fed into the hopper evenly around the crusher head so that one side of the crushing chamber does not become overloaded.

The upper bowl assembly 17 seats to the lower frame assembly so that it can separated from the lower assembly as hereinafter described. The upper bowl assembly is also constructed such that the height of the crusher bowl can be raised or lowered to adjust the clearance in crushing chamber 19. More specifically, the upper bowl assembly has an inner frame 43 having a threaded outer cylinder wall 41 held in a threaded seating ring 33. The seating ring, which seats against the top flange 39 of the lower frame assembly when the upper and lower assemblies of the crusher are engaged, includes an outwardly flared annular portion 35 which engages the inwardly flared annular portion 37 of the top flange in order to center the upper bowl assembly in respect to the axis of the crusher. Height adjustment of the crusher bowl is accomplished by rotating the inner frame 43 of the upper bowl assembly within the seating ring.

The upper bowl assembly is held in seating engagement to the lower frame assembly by means of hydraulic hold-down cylinders 51 which are arranged in pairs distributed at 90° intervals about the perimeter of the crusher. Each cylinder of the cylinder pairs has a non-extensible base end 53 connected to the lower frame assembly, an extensible top end in the form of piston rod 55 connected to the upper bowl assembly, and is inclined in two planes. First, the cylinder pairs are oppositely inclined from their base ends 53 toward each other such that the axis of the cylinders intersect at the seating ring 33. Secondly, the cylinder pairs are inclined inwardly from their base toward gyratory axis 21 such that the cylinder pairs form a conical truss arrangement with the sides of the conical truss, as represented by phantom lines A, intersecting at an apex located well above the point of nutation P of the eccentrically driven crusher head. As further described below, this conical truss arrangement provides an advantageous self-centering force for relieving the stress on the cylinders when the upper bowl assembly tilts in reaction to the over-load pressure of an uncrushable passing through crushing chamber 19.

Figure 2A:
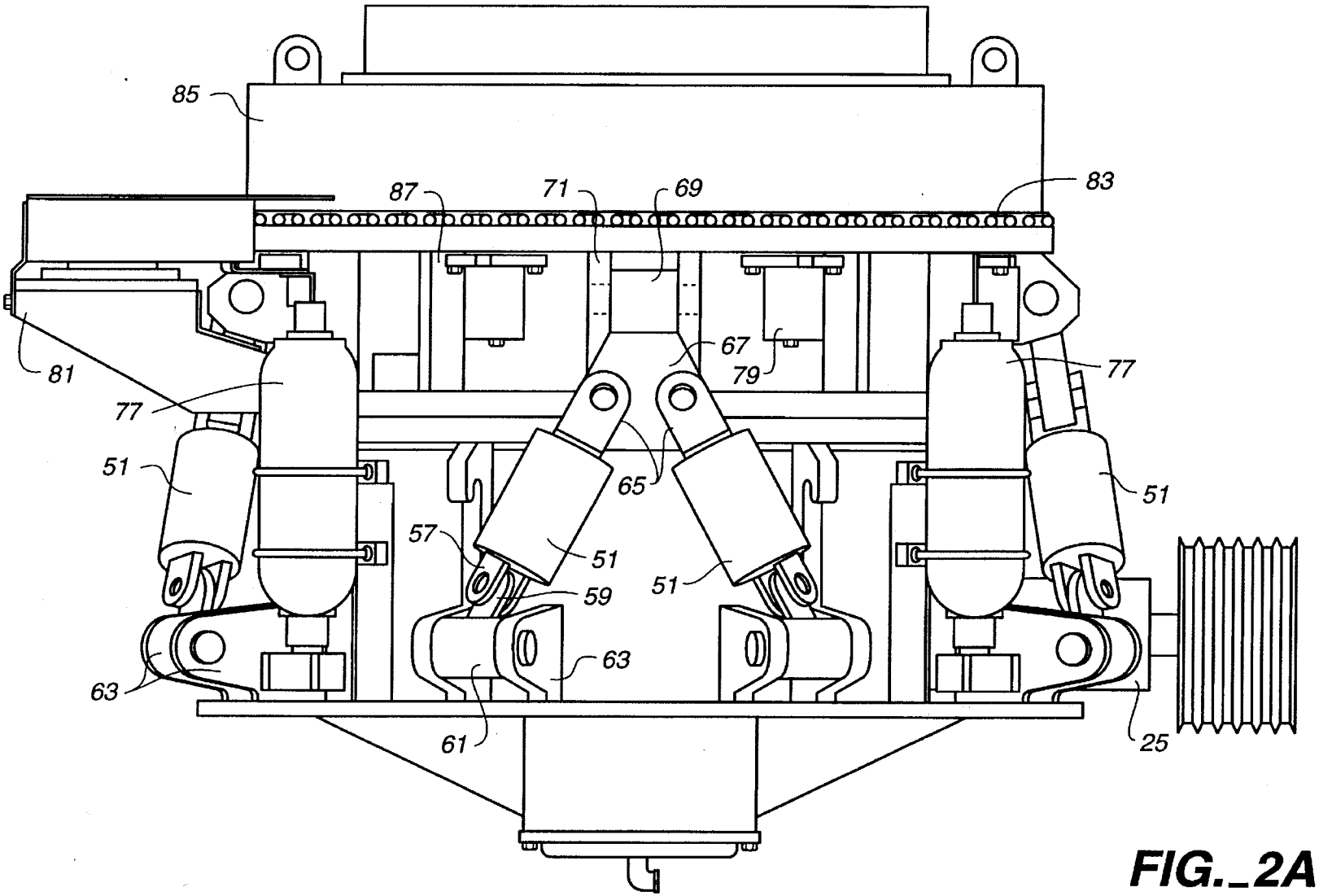
FIG. 2A is a side elevational view of a cone crusher using inclined pairs of hold-down cylinders in accordance with the invention.

Referring to FIG. 2A, the hold-down cylinders 51 are connected between the lower frame assembly and upper bowl assembly such that both the non-extensible and extensible ends of the cylinders are free to pivot about two perpendicular axes to permit the cylinders to follow radial or rotational movements of the upper bowl assembly when the upper bowl assembly breaks contact with the lower frame assembly. Specifically, the nonextensible base end of each cylinder has shackle 57 pivotally connected to coupling arm 59 of collar 61. Collar 61 is in turn pivotally connected between the projecting flanges 63 located at the bottom of the lower frame assembly 13. Similarly, the extensible top end of each cylinder has a shackle 65 pivotally connected to a coupling plate 67 which extends downwardly from of a collar 69 which in turn is pivotally connected between gussets 71 extending between the top wall 73 and side wall 75 of the seating ring. It can be seen that this coupling arrangement provides two axes of rotation for the base and top ends of the cylinders: the base end of the cylinders will be permitted to pivot around a first pivot axis formed by the pivot connection between shackles 57 and arm 59 of collar 61 and a second pivot axis formed by the pivot connection of the collar 61 to flanges 63. Likewise, the top of the cylinders will be permitted to pivot about a first pivot axis formed by the pivot connection of shackles 65 to coupling plate 67, and about a second pivot axis formed by the pivot connection between the collar 69 and gussets 71.

The hold-down cylinder pairs are arranged around the perimeter of the housing along with other operative parts of the crusher, including accumulators 77 which are part of the hydraulic control circuit hereinafter described, thread binder cylinders 79 which lockingly engage the threads of seating ring 41 to the threads 41 on the inner frame of the upper bowl assembly during operation of the crusher, the chain drive unit 81 for driving chain 83 to rotate adjustment cap 85 for rotating inner frame 43 within seating ring 33, and clearing cylinders 87 for raising the upper assembly from the top flange of the lower frame assembly in order to clear the crushing chamber. It is noted that the clearing cylinders could be eliminated altogether, thereby eliminating the added plumbing associated with the clearing cylinders, by providing hold-down cylinder pairs 51 which are double acting cylinders, that is, which, in addition to being pressurized from the top to generate a hold down force, can also be pressurized from the bottom to extend the cylinders to raise the upper bowl assembly.

Figure 3:
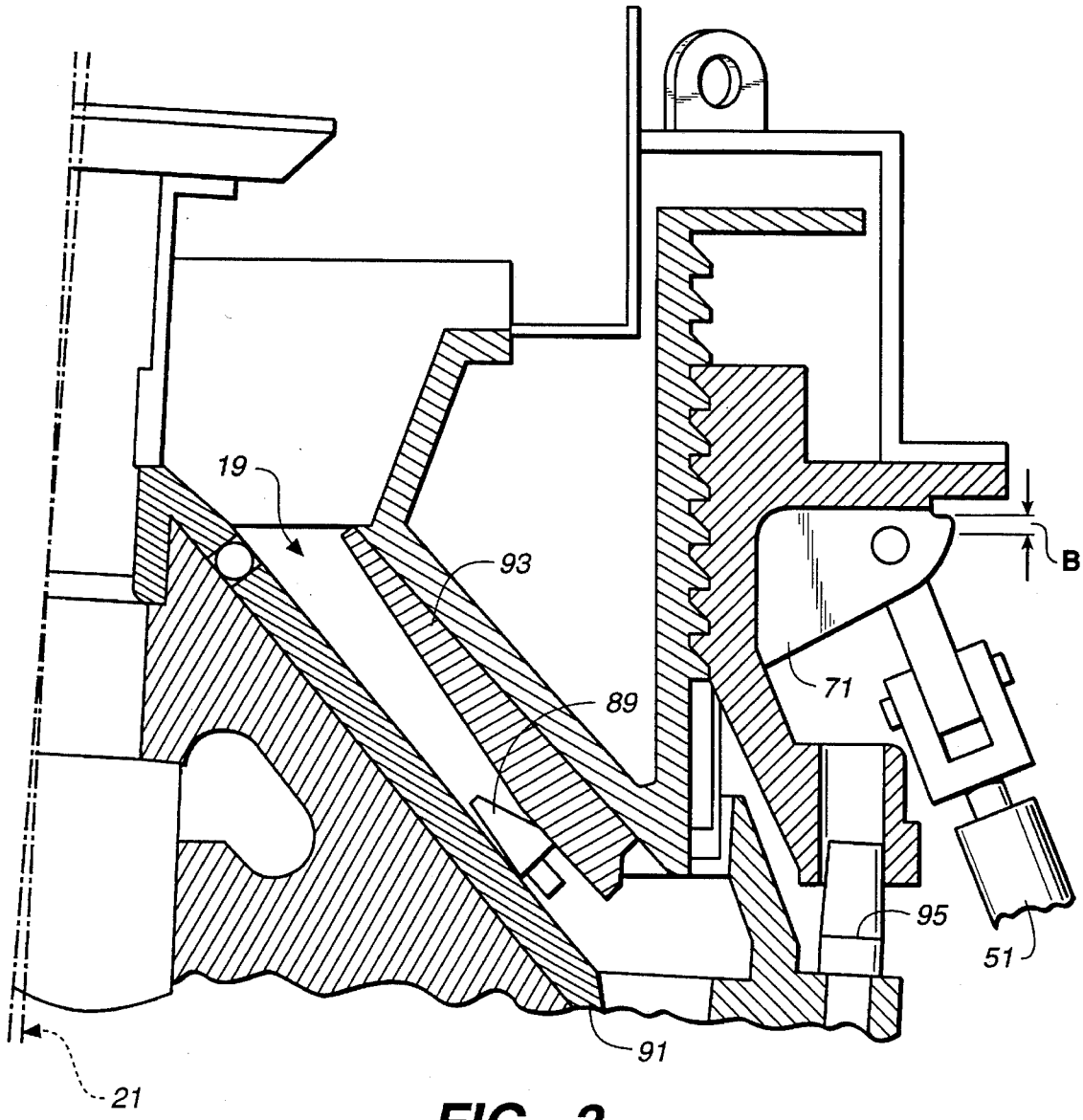
FIG. 3 is a fragmentary view, in cross-section, of a cone crusher showing the passage of an uncrushable object through the crushing chamber of the crusher.

FIG. 3 shows the upper bowl assembly 17 and the crushing chamber 19 in greater detail and particularly illustrates the separation of the upper bowl assembly from the lower frame assembly when an uncrushable passes through the crushing chamber. As an uncrushable, such as dozer tooth 89, enters the lower region of crushing chamber, it strikes the mantle 91 of the crusher head and the crusher bowl or concave 93. (In FIG. 3 it is seen that the crusher bowl is a separate crushing member mechanically secured to inner frame 43 of the upper bowl assembly.) The resulting overload condition is relieved by the hold-down cylinders 51 which permit the upper bowl assembly to be pushed away from the top flange 39 of the lower frame assembly and from the tapered guide pins 95. The entire upper bowl assembly is thus caused to tilt upwardly at the side of the crusher where the uncrushable enters the crushing chamber, as indicated by arrows B. In a conventional crusher, the degree of tilt can be expected to be in the range of 2½°. As above-mentioned, such tilting of the upper bowl assembly will tend to uncenter the upper bowl assembly in relation to the crusher's axis 21 resulting in significant lateral forces being exerted on the hold-down cylinders if the hold-down cylinders are conventionally arrayed in a vertical orientation in respect to the upper bowl assembly.

Figure 4A:
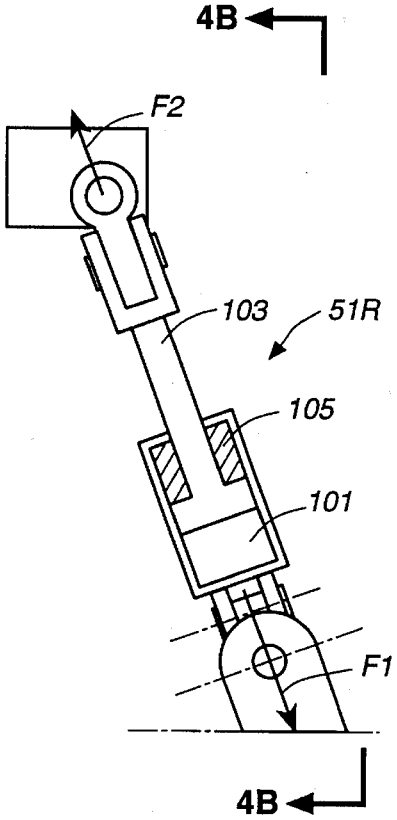
FIG. 4A and 4B are diagrammatic views of a pair of hold-down cylinders in accordance with the invention showing the inclination of the cylinder pair.
Figure 4B:
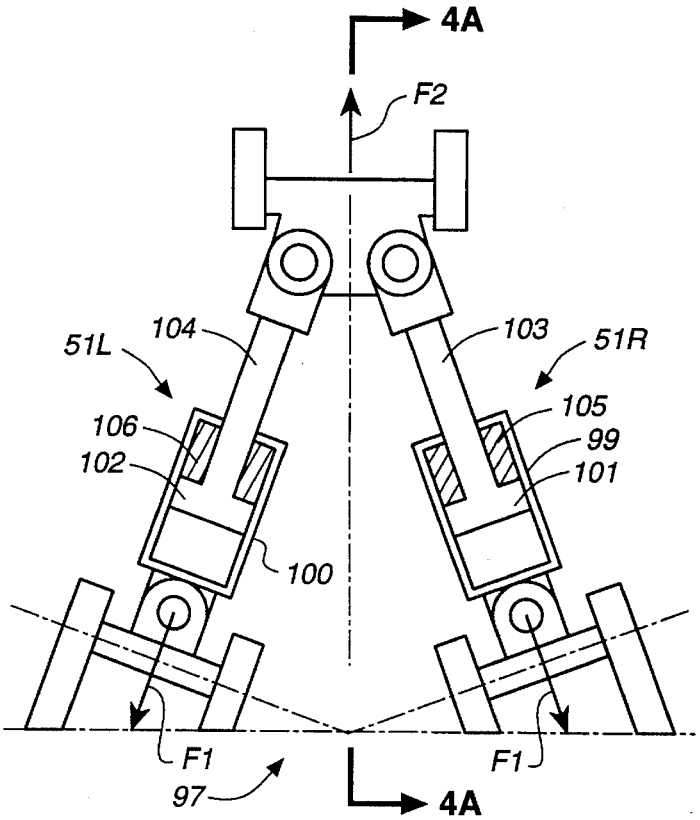
Figure 5:
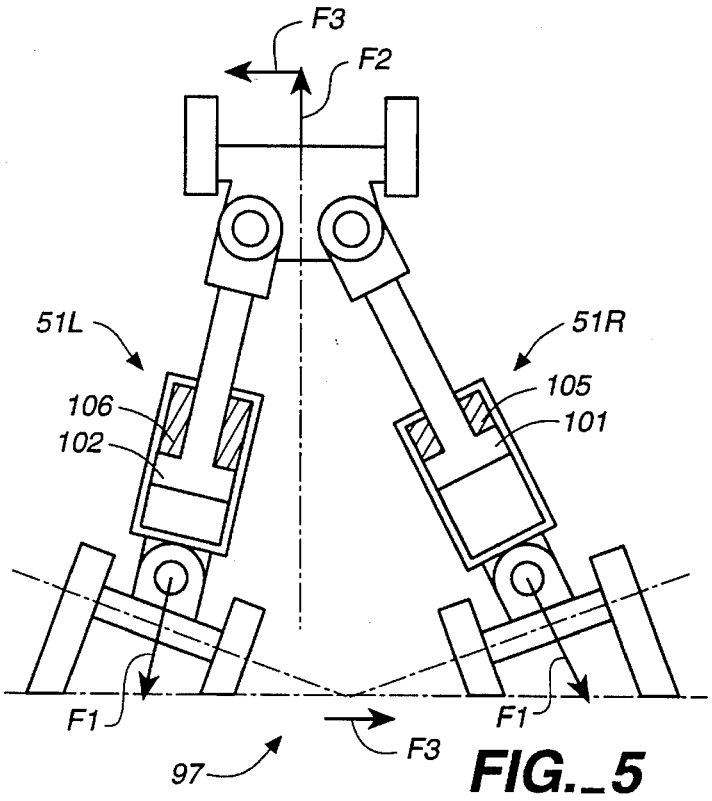
FIG. 5 is a diagrammatic representation of the cylinder pair of FIGS. 4A and 4B showing the manner in which the cylinder pairs generate anti-rotation forces for counteracting the torsional stresses imparted to the upper bowl assembly when an uncrushable enters the crusher's crushing chamber as show in FIG. 3.
Figure 6:
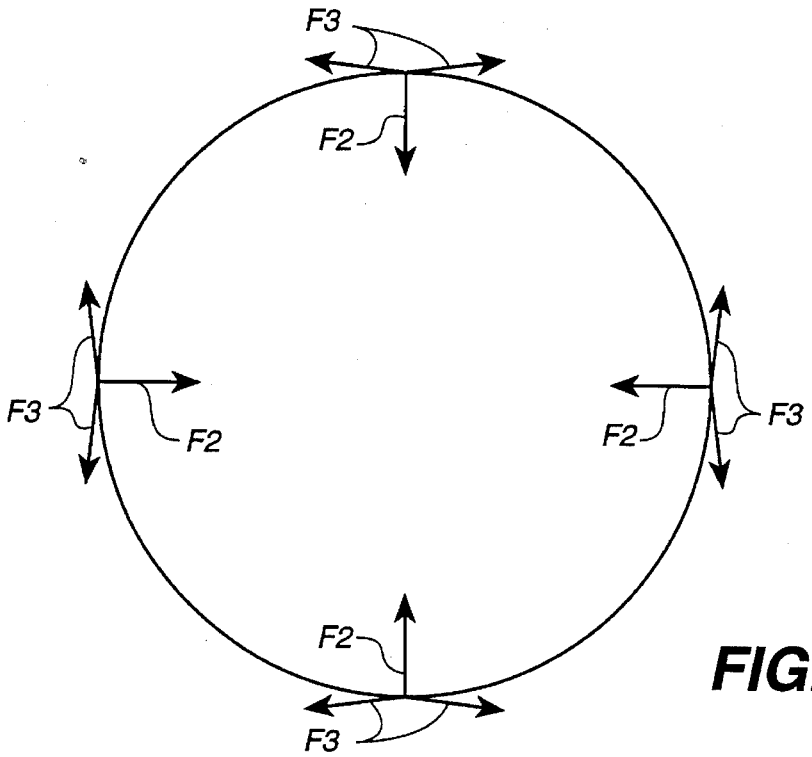
FIG. 6 is a diagrammatic representation of the self-centering and anti-rotational forces of cylinder pairs spaced at 90° intervals about the perimeter of the crusher.

The operation of the hold-down cylinders is now further described in reference to FIGS. 4–6 which illustrate the inclination of the cylinder pairs and the forces exerted by these cylinders on the upper bowl assembly. Referring to FIGS. 4A, 4B and 5, the hold-down cylinders 51A, 51B of cylinder pair 97 are generally comprised of cylinder portions 99, 100, pistons 101, 102 and piston rods 103, 104. The cylinders exert a hold-down force as denoted by force vectors F1 by providing hydraulic pressure behind the pistons 101, 102 as indicated by shaded areas 105, 106. The hold-down force thusly exerted by the cylinders is an axial force in reaction to an upwardly directed axial force vector F2 at the top of the cylinder.

FIG. 4A shows the inward inclination of cylinder pair 97 which produces a self-centering force for counteracting the upper bowl assembly's tendency to be uncentered by an uncrushable. Optimally, the angle at which the cylinder pairs are inclined as shown in FIG. 4A is chosen such that the axial force vectors of the cylinders are perpendicular to the plane of the upper bowl assembly when the upper bowl assembly is in its maximum allowable tilt angle as represented by arrows B in FIG. 3. The degree of perpendicularity between the plane of the upper bowl assembly and the cylinders will generally determine the degree of lateral shear forces of the cylinders. Suitably, the inward inclination of the cylinder pairs will be a range of about 10 to 20 degrees, placing the apex of the resulting conical truss arrangement well above the point of nutation P of the crusher head.

FIG. 5 shows the manner in which the oppositely inclined cylinder pairs can produce anti-rotational forces to counteract the torsional impact forces imparted to the upper bowl assembly when the crusher head strikes the uncrushable dozer tooth 89 shown in FIG. 3. As the upper bowl assembly 17 breaks contact with the top flange of the lower assembly, the frictional forces normally counteracting any torsional forces in the upper bowl assembly drop to approximately zero causing a sharp increase in the torsional or rotational forces exerted on the cylinders. These torsional forces are represented by rotational force vectors F3 in FIG. 5. Provided the cylinder pairs are connected to a suitable hydraulic control circuit as discussed in more detail below, rotational movement of the cylinder pair will produce a counteracting rotational force due to resulting pressure changes in the cylinders. Specifically, as the cylinder pair moves counterclockwise as shown in FIG. 5, piston 101 of cylinder 51A moves upwardly compressing the hydraulic fluid volume 105 behind the cylinder, while piston 102 of cylinder 51B moves downwardly to expand the hydraulic fluid volume 106. Differential pressures for producing an anti-rotational force will result so long as the cylinders of the cylinder pair are hydraulically isolated as described below.

FIG. 6 shows the resultant force vectors of the hydraulic cylinder pair described in connection with FIGS. 4 and 5 for four pairs of cylinders spaced at 90° intervals about the perimeter of the crusher. Specifically, in response to a tilting movement of the upper bowl assembly 17, each cylinder pair will produce self-centering force vectors F2 to counteract the tendency of the upper bowl assembly to become uncentered as it tilts away from the lower frame assembly 13, and anti-rotational force vectors F3 to counteract torsional impact forces that occur when the upper bowl assembly breaks contact with the top flange of the lower frame assembly.

Figure 7A:
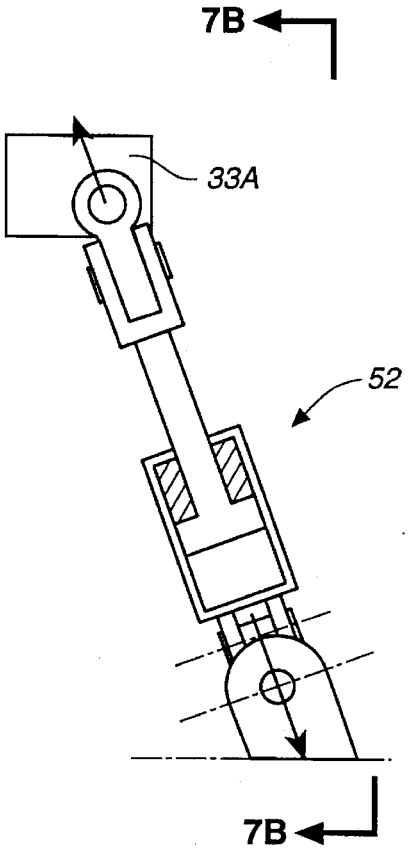
FIG. 7A and 7B is a diagrammatic representation of the deployment of a single hold-down cylinder in accordance with the invention for producing self-centering forces, but not anti-rotation forces.
Figure 7B:
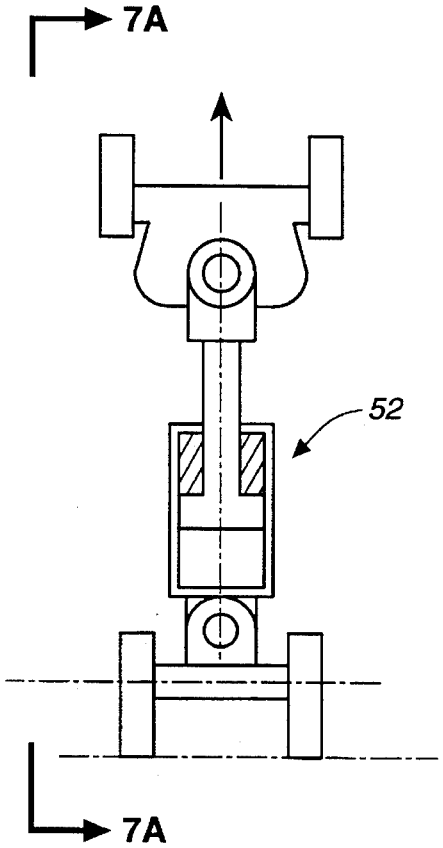

It shall be appreciated that while the best mode of the invention calls for a pairing of hydraulic cylinders, the invention contemplates the possible use of non-paired cylinders which provide a self-centering force only, as illustrated in FIGS. 7A and 7B. Specifically, in a non-paired cylinder configuration, a plurality of hold-down cylinders that are inwardly inclined as illustrated in FIG. 7A could be connected between the lower frame assembly and the seating ring 33A of the upper bowl assembly at equally spaced intervals about the perimeter of the crusher. As shown in FIGS. 7A and 7B, each cylinder 52 would provide a self-centering force as denoted by force vector F2 on the seating ring. Such an arrangement, however, would produce a minimal anti-rotational force component.

Figure 8:
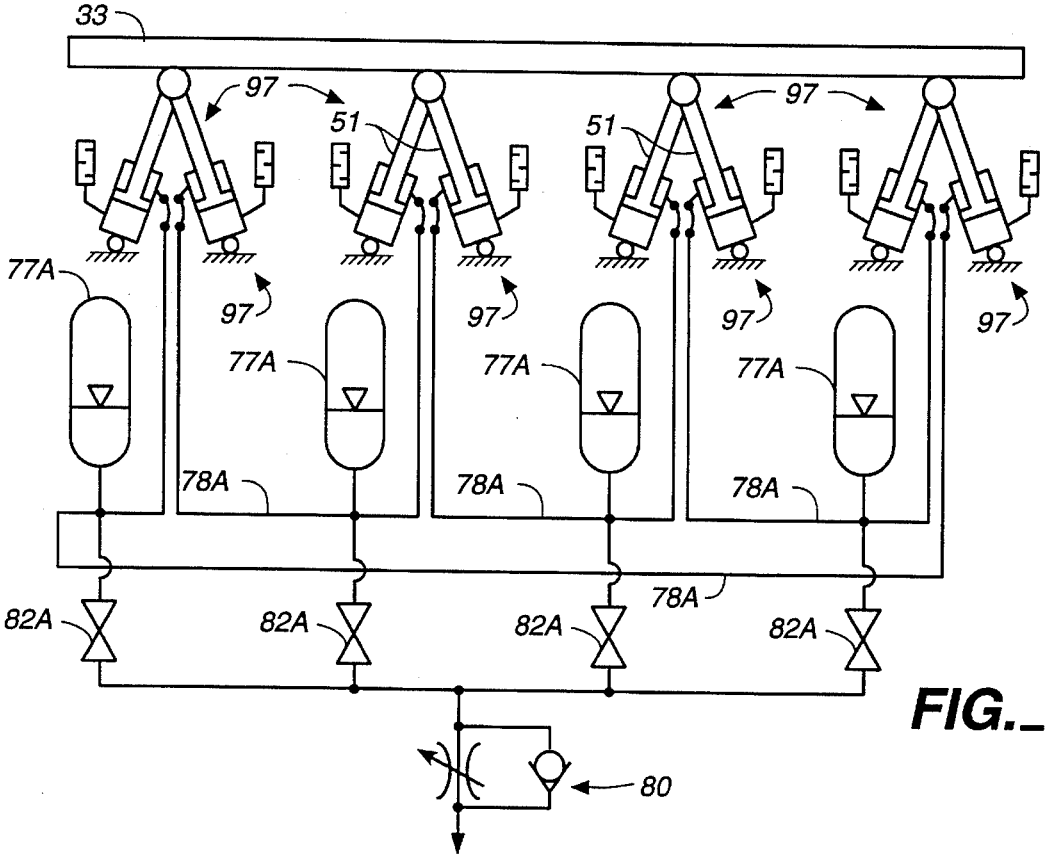
FIG. 8 is a schematic drawing of a hydraulic circuit for pressurizing the oppositely inclined hold-down cylinder pairs of the invention shown in FIGS. 1–6.
Figure 9:
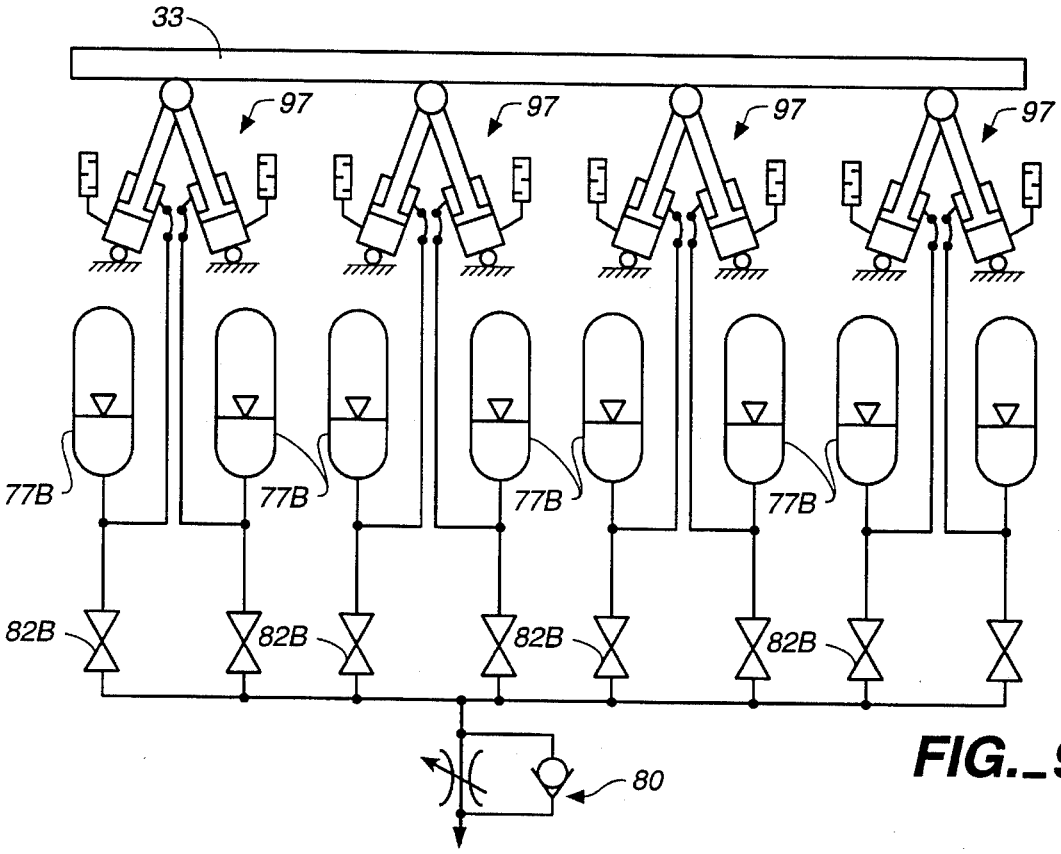
FIG. 9 is a schematic drawing of an alternative to the hydraulic circuit shown in FIG. 8.
Figure 10:
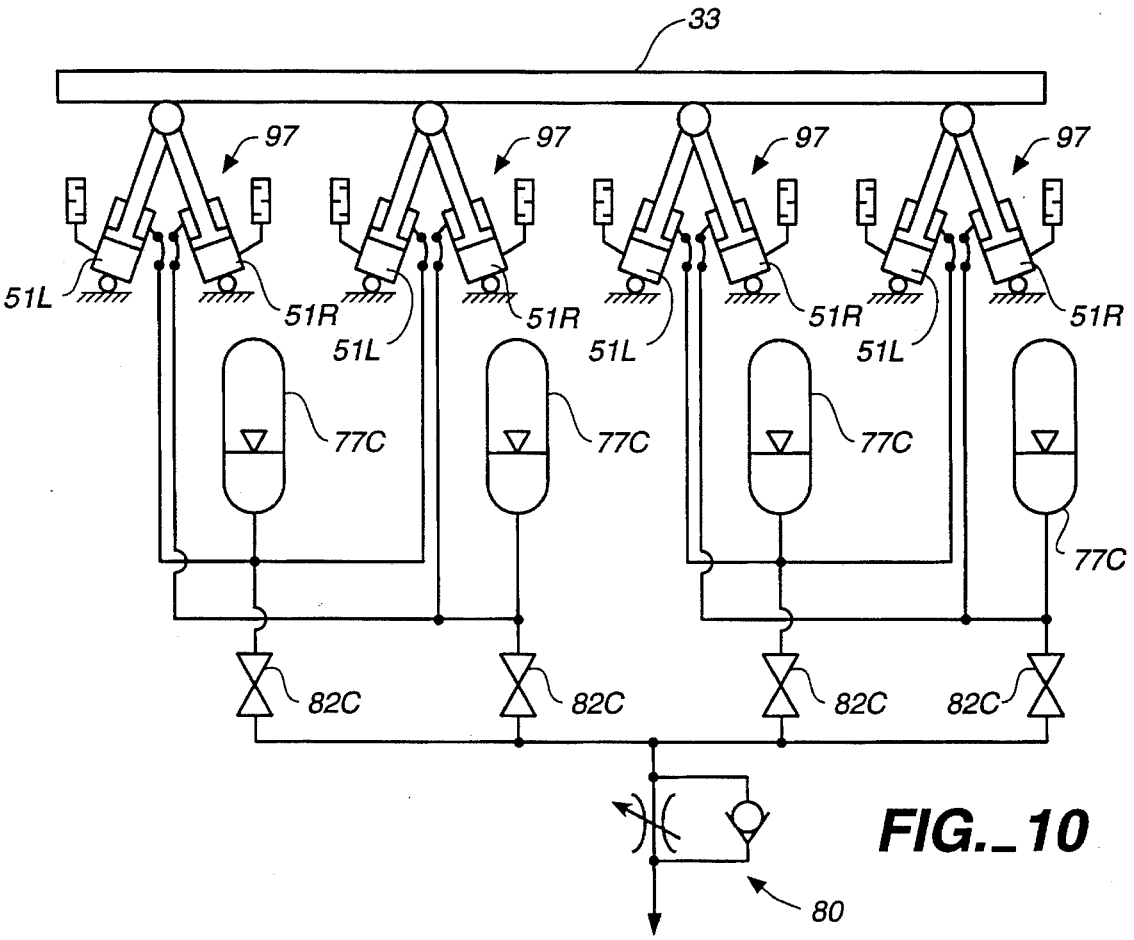
FIG. 10 is a schematic drawing showing yet another alternative to the hydraulic circuit shown in FIG. 8.
Figure 11:
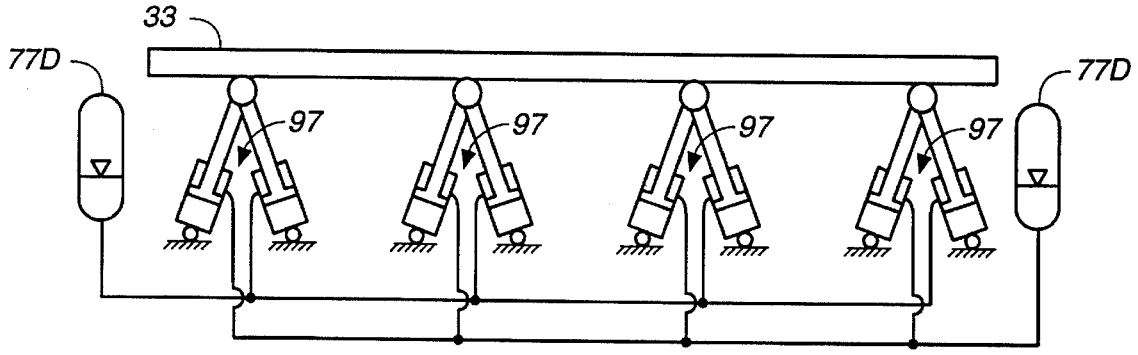
FIG. 11 is a schematic drawing of a further alternative to the hydraulic circuit shown in FIG. 8.

FIGS. 8–13 show alternative hydraulic circuits for pressurizing the hold-down cylinder pairs illustrated in FIGS. 1–6. FIG. 8 illustrates a hydraulic circuit having one accumulator for every two hydraulic cylinders wherein the accumulators are hydraulically connected to oppositely inclined cylinders. The circuit illustrated in FIG. 8 would not produce anti-rotational forces because increased pressure in one cylinder is taken up in the other of the cylinders connected to the same accumulator. This is also true in respect to the circuits shown in FIGS. 12 and 13. In FIGS. 9, 10, and 11 oppositely inclined cylinders are isolated from one another so that anti-rotational forces can be produced as described above.

More specifically, in FIG. 8, cylinder pairs 97, which are pictorially shown as being connected to seating ring 33, hydraulically communicate with four accumulators 77A through hydraulic lines 78A with one accumulator being provided for two oppositely inclined cylinders of adjacent cylinder pairs. Each accumulator circuit is connected through an adjustable flow control valve 80 to hydraulic pressure and return lines (not shown) through a directional solenoid valve (not shown); each accumulator circuit can additionally be isolated manually by means of valves 82A.

In FIG. 9, each cylinder of cylinder pairs 97 communicates with its own accumulator 77B thereby totally isolating each cylinder from the other cylinders. This circuit doubles the number of required accumulators and accumulator circuits.

In FIG. 10, one accumulator 77C is provided for two cylinders, but in this case, each accumulator circuit connects to cylinders having the same direction of inclination such that cylinders, e.g. cylinders 51L, of one inclination are isolated from oppositely inclined cylinders 51R. As compared to the circuit of FIG. 9, this circuit reduces the number of accumulators and shut-off valves needed while providing the cylinder pairs the capability of producing anti-rotational force components.

Figure 12:
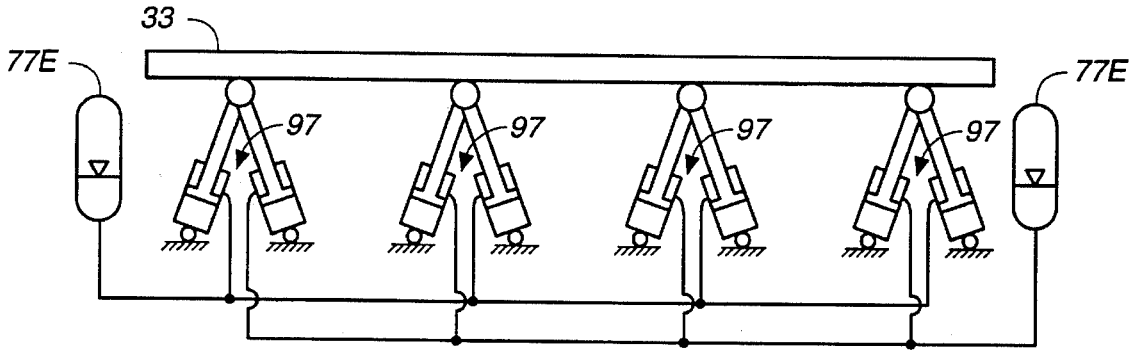
FIG. 12 is a schematic drawing of still a further alternative to the hydraulic circuit shown in FIG. 8.
Figure 13:
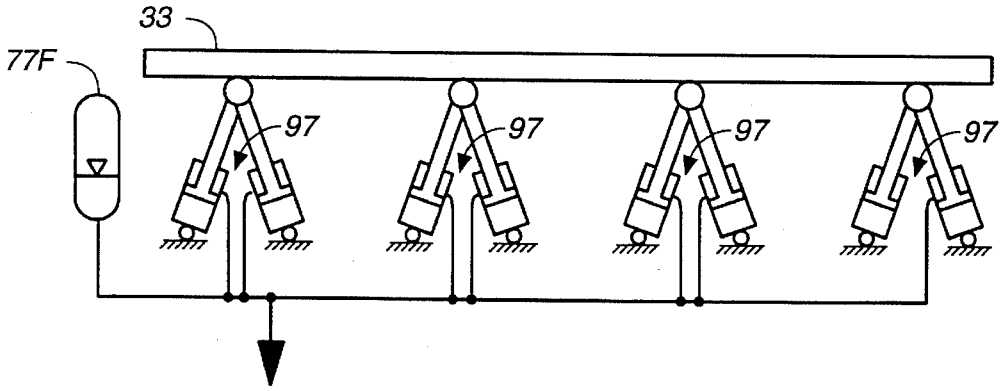
FIG. 13 is a schematic drawing of yet a further alternative to the hydraulic circuit shown in FIG. 8.

The hydraulic circuits shown in FIGS. 11 and 12 have just two accumulators 77D and 77E for the hydraulic cylinder pairs 97: in FIG. 11 all similarly inclined cylinders communicate with a single accumulator whereas in FIG. 12 one accumulator handles alternating cylinder pairs. In FIG. 13 all the cylinders pairs 97 are connected to but a single accumulator 77F. The reduction in the number of accumulators in the circuits of FIGS. 11–13 will reduce plumbing requirements and costs; such a reduction, it is believed, can be achieved without substantial loss in operating efficiency, provided the accumulators have sufficient capacity.

It is noted that various electrical interlocks (not shown) can be provided to prevent possible damage to the crusher when its various systems are in use. For example, The hold-down cylinders can be interlocked to the clearing cylinders such that the two can not operate simultaneously. An interlock can also be provided to signal a drop in pressure in the hold-down cylinders. Such interlock systems are well known in the art.

Therefore, it can be seen that the present invention provides hydraulic overload protection for a cone crusher in which wear and tear on the hydraulic hold-down cylinders of the system is reduced. While the invention has been described in considerable detail in the foregoing specification and accompanying drawings, it shall be understood that it is not intended that the invention be limited to such detail. For example, the invention is not limited to the use of hydraulic hold-down cylinders, but is intended to encompass other types of cylinders, for example, magnetic cylinders. However, hydraulic cylinders are considered to be the most suitable choice of extensible hold-down devices. Also, it is understood that the extensible portion of the cylinders may be connected to the lower frame assembly instead of the upper bowl assembly such that the extensible end of the cylinders becomes the cylinder's defined base end and the non-extensible end of the cylinders becomes the top end connected to the seating ring. This configuration is not recommended, however, since it will place considerable stress on the hose connections to the cylinders.

What I claim is:

1. A cone crusher comprising a lower frame assembly having a crusher head eccentrically driven about a gyratory axis, an upper bowl assembly, including an inverted concave crusher bowl, seated to said lower frame assembly such that the crusher bowl of said upper bowl assembly opposes the crusher head of said lower frame assembly to form an annular crushing chamber therebetween, and a plurality of hold-down cylinders connected between said upper bowl assembly and said lower main frame assembly for releasably holding said upper bowl assembly in seating engagement against said lower frame assembly, each of said cylinders having a base end pivotally connected to said lower frame assembly and an top end pivotally connected to said upper bowl assembly, said hold-down cylinders being inclined from their base ends inwardly toward said gyratory axis when the upper bowl assembly is in seating engagement with the lower frame assembly.

2. The cone crusher of claim 1 wherein said eccentrically driven crusher head has a defined point of nutation, and wherein said hold-down cylinders are arranged to form the side of a cone, the apex of which is located substantially above the point of nutation of said crusher head.

3. The cone crusher of claim 1 wherein said hold-down cylinders are arranged in pairs and wherein the cylinders in each said pair of cylinders are further oppositely inclined toward each other from their base ends.

4. The cone crusher of claim 1 including double pivot means associated with the base and top ends of each of said hold-down cylinders for providing each of said base and top ends with two degrees of rotation when the upper bowl assembly moves relative to the lower frame assembly.

5. A cone crusher comprising a lower frame assembly having an eccentrically driven crusher head, an upper bowl assembly including an inverted concave crusher bowl, said upper bowl assembly being seated on said lower frame assembly such that the crusher bowl of said bowl assembly opposes the crusher head of said lower frame assembly to form an annular crushing chamber therebetween, and a plurality of hold-down cylinders connected between said upper bowl assembly and said lower main frame assembly for holding said upper bowl assembly in seating engagement against said lower frame assembly, each of said cylinders having a base end pivotally connected to said lower frame assembly and a top end pivotally connected to said upper bowl assembly, said hold-down cylinders being arranged in pairs, with the cylinders in each pair of cylinders being oppositely inclined toward each other from their base ends.

6. The cone crusher of claim 5 wherein said crusher head is eccentrically driven about a gyratory axis and said hold-down cylinders are further inclined from their base ends inwardly toward said gyratory axis, wherein said eccentrically driven crusher head has a defined point of nutation, and wherein said hold-down cylinders are arranged to form the side of a cone, the apex of which is located substantially above the point of nutation of said crusher head.

7. A cone crusher comprising a lower frame assembly having an eccentrically driven crusher head, an upper bowl assembly, including an inverted concave crusher bowl, seated to said lower frame assembly such that the crusher bowl of said bowl assembly opposes the crusher head of said lower frame assembly to form an annular crushing chamber therebetween, a plurality of hydraulic hold-down cylinders connected between said upper bowl assembly and said lower main frame assembly for holding said upper bowl assembly in seating engagement against said lower frame assembly, each of said cylinders having a base end pivotally connected to said lower frame assembly and a top end pivotally connected to said upper bowl assembly, said plurality hold-down cylinders being arranged in pairs with the cylinders in each pair of cylinders being oppositely inclined toward each other from their base ends, and hydraulic circuit means for pressurizing said hold-down cylinders such that the extension of one cylinder in a pair a cylinders is resisted by the retraction of the other cylinder of such pair of cylinders so as to counteract torsional forces imparted to said upper bowl assembly.

8. A cone crusher comprising a lower frame assembly having an eccentrically driven crusher head, an upper bowl assembly, including an inverted concave crusher bowl, seated to said lower frame assembly such that the crusher bowl of said bowl assembly opposes the crusher head of said lower frame assembly to form an annular crushing chamber therebetween, said lower frame assembly and upper bowl assembly having defined perimeters forming the perimeter of the cone crusher, a plurality of hydraulic hold-down cylinders connected around the perimeter of the cone crusher between said upper bowl assembly and said lower frame assembly for holding said upper bowl assembly in seating engagement against said lower frame assembly, each of said cylinders having a base end pivotally connected to said lower frame assembly and a top end pivotally connected to said upper bowl assembly, said plurality hold-down cylinders being arranged in pairs with the cylinders in each pair of cylinders being oppositely inclined toward each other from their base ends, and a hydraulic circuit for pressurizing said hold-down cylinders including at least one accumulator operatively connected thereto.

9. The cone crusher of claim 8 wherein one accumulator is provided for each two hydraulic cylinders.

10. The cone crusher of claim 9 wherein each of said accumulators is operatively connected to cylinders that are in different pairs of cylinders.

11. The cone crusher of claim 10 wherein the cylinders to which each accumulator is connected are in adjacent pairs of cylinders.

12. The cone crusher of claim 9 wherein each of said accumulators is operatively connected to cylinders in the same pair of cylinders.

13. The cone crusher of claim 8 wherein an accumulator is provided for each cylinder.

14. The cone crusher of claim 8 wherein one accumulator is provided for all cylinder pairs.

15. The cone crusher of claim 8 wherein four pair of eight hydraulic cylinders are provided at approximately 90 degree intervals around the perimeter of the crusher, and one accumulator is provided for each four of said eight cylinders.

16. The cone crusher of claim 15 wherein one accumulator is provided for two cylinder pairs.

17. The cone crusher of claim 15 wherein one accumulator is provided for all cylinders of said pairs of cylinders which are inclined in the same direction.

* * * * *